United States Patent [19]

Andersen-Vie

[11] Patent Number: 4,913,009

[45] Date of Patent: Apr. 3, 1990

[54] RATCHET WRENCH

[75] Inventor: Axel E. Andersen-Vie, Jackson, Mich.

[73] Assignee: Jackson Assembly Enterprises, Inc., Lansing, Mich.

[21] Appl. No.: 237,320

[22] Filed: Aug. 29, 1988

[51] Int. Cl.[4] ..... C25B 13/00

[52] U.S. Cl. ..... 81/58.5; 81/58.4; 81/58

[58] Field of Search ..... 81/58.5, 58.4, 58.3, 81/58.2, 58.1, 58

[56] References Cited

U.S. PATENT DOCUMENTS

| | | | |
|---|---|---|---|
| 1,425,816 | 8/1922 | Van Horn | 81/58.5 |
| 1,668,222 | 5/1928 | Troha | 81/58.5 |
| 2,696,748 | 12/1954 | Relken | 81/61 |
| 2,796,790 | 6/1957 | Wiltsey et al. | 81/60 |
| 3,255,647 | 6/1966 | Gray | 81/63.1 |

FOREIGN PATENT DOCUMENTS

| | | | |
|---|---|---|---|
| 0075001 | 3/1867 | France | 81/58.5 |
| 0019245 | 5/1899 | Switzerland | 81/58.5 |
| 0003064 | of 1877 | United Kingdom | 81/58.5 |

*Primary Examiner*—Frederick R. Schmidt
*Assistant Examiner*—Lawrence Cruz
*Attorney, Agent, or Firm*—Beaman & Beaman

[57] ABSTRACT

An inexpensive ratchet wrench primarily consisting of stamped metal parts having a head pivotally mounted upon an elongated handle. A torque transfer member utilizing ratchet teeth is rotatably mounted upon the head and a detent fixed upon an end of the handle selectively engages the ratchet teeth as the head pivots relative to the handle during torqueing and return handle movements. Stop means interposed between the head and handle limit relative pivotal movement therebetween, and a spring imposes a biasing action on the head biasing the head in a direction engaging the torque transfer member ratchet teeth with the handle detent.

3 Claims, 1 Drawing Sheet

RATCHET WRENCH

BACKGROUND OF THE INVENTION

Ratchet wrenches have the advantage of permitting the wrench to maintain engagement with the nut or bolt being torqued during the wrench return movement. Such wrenches are widely used in the mechanical arts, and take many forms.

Usually, ratchet wrenches consist of a handle upon which a torque member is rotatably mounted. Ratchet teeth on the torque member engage with a pivoted handle-mounted detent, and the detent is so positioned as to transmit torque to the torque member during unidirectional movement of the handle and permit the detent to "ride over" the ratchet teeth during the handle return movement. Usually, the direction of torquing reversal is controlled by a detent actuator. Conventional ratchet wrenches require considerable machining and fabrication, and are relatively expensive.

Ratchet wrenches have been proposed having a head pivotally mounted upon a handle wherein the head includes a rotatable torque transfer member and a detent mounted on the handle selectively engages the torque member ratchet teeth depending on the pivotal orientation of the head to the handle during the torque transfer and return handle movements. Ratchet wrenches of this type are shown in U.S. Pat. Nos. 2,796,790 and 3,255,647. However, such prior art ratchet wrenches, while of a simpler design than many ratchet wrench constructions, are still relatively complex and cannot be economically manufactured.

It is an object of the invention to provide a low cost ratchet wrench which is primarily constructed of stamped metal components.

Another object of the invention is to provide a ratchet wrench primarily formed of stamped metal components wherein a head is pivotally mounted upon the end of a handle, and a handle-mounted detent selectively engages a head-mounted torque transfer member having ratchet teeth, and stop means interposed between the head and handle limit the pivotal movement therebetween.

A further object of the invention is to provide a low cost ratchet wrench which is dependable in operation, simple to use, rugged and dependable, and which will remain operative over long periods of nonuse.

In the practice of the invention an elongated handle formed of sheet or plate material includes a head pivotally mounted thereon adjacent one end. The head is formed by a pair of plates maintained in parallel spaced relationship by rivets and a torque transfer member in the form of a circular socket sleeve is rotatably mounted upon the head plates and includes concentric ratchet teeth located between the plates. A pin and slot arrangement defined in the handle and head limits the degree of pivotal movement of the head relative to the handle.

A detent is defined upon the handle end adjacent the head and is so related to the ratchet teeth that as the head pivots relative to the handle between torque transfer and handle return positions, the detent and ratchet teeth selectively engage. Pivotal movement of the head relative to the handle results from the transfer of torque, and, automatically, the detent will engage the torque member ratchet teeth during the transfer of torque, and disengage therefrom during return movement of the handle.

A spring interposed between the handle and head biases the head toward a ratchet teeth-detent engaging position, and the torque transfer means is symmetric with respect to its axis of rotation whereby the direction of torqueing can be reversed merely by reversing the position of the handle on the member being rotated.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
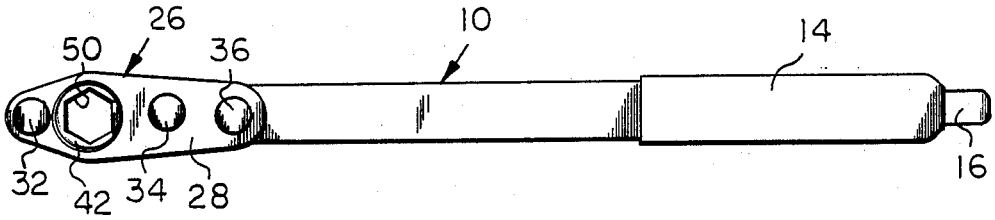
FIG. 1 is a plan view of a ratchet wrench in accord with the invention.
Figure 2:
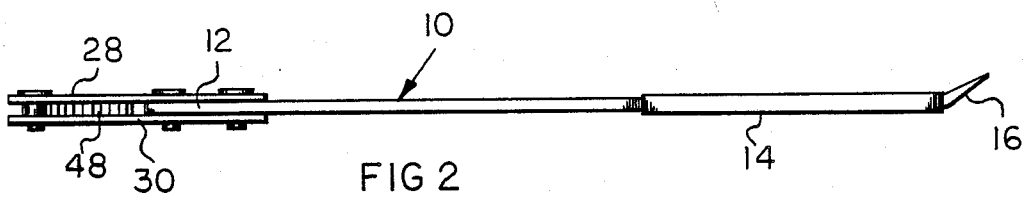
FIG. 2 is a side elevational view.

As illustrated in the drawings, the ratchet wrench handle is generally designated at 10 which is formed of a stamped steel plate material and includes an end 12 and a handle 14 which may consist of an elastomeric covering or urethane sheath. A tang 16 is defined on the handle outer end and deflected from the general plate of the handle 10 to function as a prying tool. The ratchet wrench of the invention is particularly suitable for use in rotating a vehicle scissors jack and the tang 16 is employed to remove wheel covers.

The handle end 12 includes a hole 18 for receiving a fastener, as later described, and the detent 20 is homogeneously defined of the handle material on the end of portion 12. Portion 12 is also formed with a slot 22, FIG. 4, extending transversely of the handle length, and the slot 22 communicates with a spring chamber 24 wherein the slot 22 and chamber 24 define an L-shaped opening.

Figure 3:
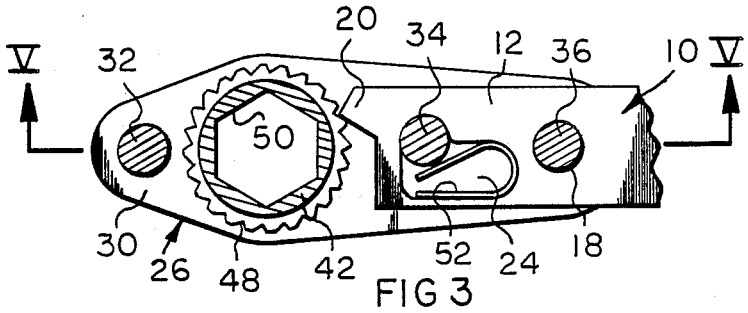
FIG. 3 is an enlarged plan, detail, sectional view of the ratchet wrench head as taken along Section III—III of FIG. 5 illustrating the handle detent in engagement with the torque transfer ratchet teeth.
Figure 4:
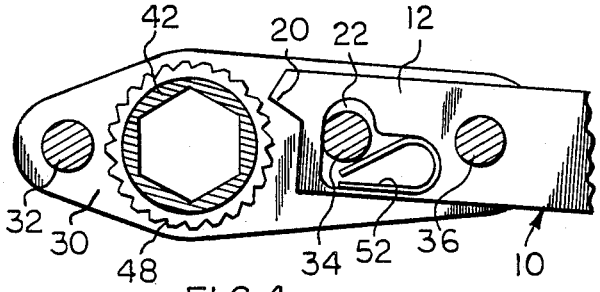
FIG. 4 is an enlarged, sectional, plan, detail view similar to FIG. 3 illustrating the detent disengaged from the torque member ratchet teeth.
Figure 5:
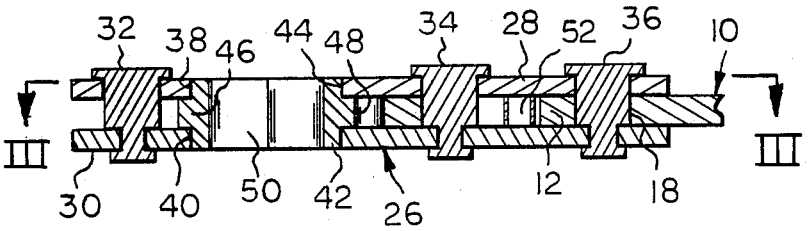
FIG. 5 is an enlarged, detail, elevational, sectional view of the head as taken along Section V—V of FIG. 3.

The ratchet wrench head is generally designated at 26 and includes substantially identical plates 28 and 30 whose configuration will be readily appreciated from FIGS. 1, 3 and 4. The plates 28 and 30 are identical except for the sizes of the holes defined therein for receiving rivet fasteners 32, 34 and 36. Plate 28 has larger rivet holes than plate 30 to accommodate the configuration of the rivets as will be readily appreciated from FIG. 5.

The plates 28 and 30 are stamped of sheet material and a hole 38 is defined in plate 28 while an aligned identical hole 40 is defined in plate 30.

The torque transfer member is in the form of a circular socket 42 which includes reduced diameter cylindrical portions 44 adjacent the socket ends which are rotatably received within holes 38 and 40. The socket includes an enlarged portion 46 intermediate the surfaces 44, and the periphery of the enlarged portion 46 is provided with ratchet teeth 48 as best illustrated in FIGS. 3 and 4. Internally, the socket 42 is provided with a hexagonal opening 50 for receiving a complementarily shaped nut or bolt head for establishing a torque transferring relationship therewith. It is to be appreciated that the socket member 42 could support hexagonal or square-shaped studs, rather than a hexagonal opening, for torque transfer purposes.

The head rivet 34 is received within the handle slot 22, and the rivet 36 constitutes a pivot for the head in that the rivet 36 extends through the handle hole 18 and pivotally mounts the head 26 upon the handle 10. The presence of the rivet 34 within slot 22 limits the relative rotational pivoting of the head 26 upon the handle 10, and as will be appreciated from FIG. 3, when the head 26 is pivoted its maximum clockwise direction with respect to the handle 10 such that the rivet 34 engages the end of the slot 22, the detent 20 will be engaging a ratchet tooth 48 preventing relative rotation between the member 42 and the head or handle 10.

When the head 26 is pivoted in a counterclockwise direction with respect to rivet 36, as shown in FIG. 4, the rivet 34 is received within the central region of the slot 22 and the detent 20 disengages from the ratchet teeth 48 permitting rotation of the torque transfer socket 42.

A leaf spring 52 is located within chamber 24 and bears against the chamber and the rivet 34. In this manner the head 26 is biased in a clockwise direction with respect to the handle 10 about rivet 36, which engages the detent 20 with ratchet teeth 48 in the ratchet wrench "normal" condition.

To use the wrench of the invention the hexagonal head of the member to be rotated, such as a scissors jack screw, nut or bolt, is inserted into the hexagonal opening 50 of the torque transfer socket 42. Due to the biasing force of the spring 52 the detent 20 will be engaging the ratchet teeth 48. Thereupon, counterclockwise rotation of the handle 10 about the axis of the member being torqued, i.e. the axis of socket 42, will transfer torque from the handle 10 through the detent 20 and ratchet teeth 48 to the socket 42 and the member therein.

When the ratchet handle 10 is rotated in the clockwise direction, as viewed in FIG. 4, the handle 10 will pivot relative to the head 26 as shown in FIG. 4 disengaging detent 20 from ratchet teeth 48 and this return movement of the handle permits the handle to be positioned as desired for producing another torquing or tightening movement of the handle to establish the relationship of FIG. 3. Accordingly, it will be appreciated that the ratchet wrench of the invention is used in the normal ratchet wrench manner wherein a unidirectional rotation of the torque transfer socket 42 occurs as the handle 10 is oscillated back and forth.

If it is desired to reverse the direction of torque transfer with the ratchet wrench, the wrench is removed from the member being tightened, reversed 180°, and reinserted thereon. This will permit the handle 10 to transfer torque to the member being tightened in the opposite direction than previously.

It is to be appreciated that use of the spring 52 is not mandatory as it is, basically, the resistance to rotation of the head 26 which determines the angular relationship of the handle 10 thereto. Thus, the inventive concepts may be practiced with a ratchet wrench identical to that disclosed omitting the spring 52.

As the handle 10, and plates 28 and 30, which comprise the main components of the disclosed ratchet wrench, may be formed of plate material by a stamping operation, such components may be economically produced, and all of the components of the wrench may be readily manufactured at minimal costs. The simplicity of the wrench of the invention lowers the cost of assembly and provides a rugged heavy duty wrench capable of transmitting high torques which is not adversely affected by dirt and foreign matter. The "open" configuration of the head 26 renders the moving parts of the wrench to be self cleaning of foreign matter.

It is appreciated that various modifications to the invention may be apparent to those skilled in the art without departing from the spirit and scope of the invention.

I claim:

1. A ratchet wrench characterized by its use of flat stamped components comprising, in combination, an elongated handle having first and second ends, a detent defined upon said first end, a pivot defined upon said handle adjacent said first end having an axis transverse to the length of said handle, a head mounted on said pivot for pivotal movement relative to said handle between first and second positions defined by a pair of substantially identically configured spaced, parallel plates, said handle and plates being formed of flat stamped material, a torque transfer member extending between and rotatably mounted upon said plates about an axis substantially parallel to the axis of said pivot, a plurality of ratchet teeth defined on said member intermediate said plates and concentric to said member axis, said plates being open at their periphery to provide access to said teeth throughout the circumference of said member, said detent engaging said teeth at said head first pivotal position to lock said member relative to said handle and disengaging from said teeth at said head second pivotal position to permit free rotation of said member relative to said head, stop means interposed between said handle first end and said head limiting relative rotation of said head on said handle pivot, said stop means including a first element fixed upon said handle first end and a second element fixed upon said head, one of said stop means elements comprising a pin and the other of said elements comprising an opening receiving said pin, said pin being mounted on said head extending between said plates and located intermediate said torque transfer member and said pivot, said opening comprising a slot defined in said handle adjacent said first end intermediate said detent and said pivot, a spring mounted in said slot interposed between said handle and said pin biasing said head toward said first position, fasteners maintaining said plates in spaced parallel relationship, aligned bearing openings defined in said plates, said torque transfer member being rotatably received within said bearing openings, said plates each including an outer end portion extension extending on the opposite side of said torque transfer member with respect to said pivot, one of said fasteners extending through both of said of said plates' extensions and interconnecting said plates' outer end portions extensions to prevent separation thereof.

2. In a ratchet wrench as in claim 1, said fasteners, pin and pivot comprising identical shouldered rivets.

3. In a ratchet wrench as in claim 1, said spring mounted in said slot interposed between said handle and said pin biasing said head toward said first position comprising a U-shaped leaf spring.

* * * * *